United States Patent [19]

Longbrake

[11] 4,320,892

[45] * Mar. 23, 1982

[54] KNIFE SHARPENER

[76] Inventor: Howard R. Longbrake, 16740 Indian Hollow Rd., Grafton, Ohio 44044

[ * ] Notice: The portion of the term of this patent subsequent to Oct. 9, 1996, has been disclaimed.

[21] Appl. No.: 220,899

[22] Filed: Dec. 29, 1980

Related U.S. Application Data

[63] Continuation-in-part of Ser. No. 78,441, Sep. 24, 1979, abandoned, which is a continuation of Ser. No. 899,109, Apr. 24, 1978, abandoned.

[51] Int. Cl.[3] ..... B24B 3/54; B21K 5/12; B25B 3/00

[52] U.S. Cl. ..... 269/3; 51/135 R; 51/221 BS

[58] Field of Search ..... 269/1-3, 269/6, 87, 87.1, 87.2, 87.3, 900, 4; 76/82, 82.2, 88; 51/135 R, 143, 218 R, 218 A, 218 P, 221 R, 221 BS, 224; 29/76 A

[56] References Cited

U.S. PATENT DOCUMENTS

| | | | |
|---|---|---|---|
| 3,733,933 | 5/1973 | Longbrake | 269/3 |
| 3,819,170 | 6/1974 | Longbrake | 269/3 |
| 4,170,343 | 10/1979 | Longbrake | 269/3 |

*Primary Examiner*—Harold D. Whitehead
*Assistant Examiner*—K. Bradford Adolphson
*Attorney, Agent, or Firm*—Clyde H. Haynes; Gustalo Nunez

[57] ABSTRACT

A portable knife sharpener comprising two duplicate bar or narrow plate-like clamp members connected together adjacent to but spaced from their one ends for pivotal movement about axes generally parallel with the planes thereof and having facing planar surfaces with linear edges at their ends closest to their pivotal connection. A thumb screw is threaded in one of the clamp members intermediate its end opposite to said one end and its pivotal connection with the other clamp member the end of which clamp screw abutts the other clamp member. A discrete flange or angle-like member is pivotally connected by one flange part thereof to the side of each of the clamp members not facing the other clamp member with the other flange part of the member extending normal to the planar surface of the clamp member to which it is connected. Each of said angle-like members has a plurality of apertures therein spaced like distances from the planar surface of the clamp member to which it is connected. In one embodiment apertures are laterally offset from the clamp member.

2 Claims, 3 Drawing Figures

KNIFE SHARPENER

RELATED APPLICATIONS

This application is a continuation-in-part of my copending U.S. Patent application, Ser. No. 078,441 filed Sept. 24, 1979, now abandoned, which is a continuation of application Ser. No. 899,109 filed Apr. 24, 1978 (now abandoned).

BACKGROUND OF THE INVENTION

1. Field of the Invention

This invention relates to work holders and more particularly to portable knife sharpeners.

2. Description of the Prior Art

Typically knives and the like are sharpened by effecting relative movement between the cutting edge thereof and an abrasive or other sharpening member. Various types of knife holders have been suggested for facilitating the sharpening of knives but such holders have various disadvantages, for example, inability to assure the sharpening of like bevels on both sides of the cutting edge of the blade being sharpened.

SUMMARY OF THE INVENTION

The invention provides a novel and improved portable knife sharpener which is inexpensive to produce and with the use of which like bevels can be produced with certainty on opposite sides of the cutting edge of a knife being sharpened.

Another aspect of the invention is the provision of a knife sharpener of the character mentioned which if one wishes can be held in one hand with a knife or the like clamped therein while a sharpening member held in the other hand is moved over the cutting edge of the knife.

A further aspect of the invention is the provision of a knife sharpener of the character mentioned which does not impose any limitations on the degree of bevel which can be sharpened on the cutting edge of the work or instrumentality being sharpened.

DESCRIPTION OF THE PREFERRED EMBODIMENT

Figure 1:
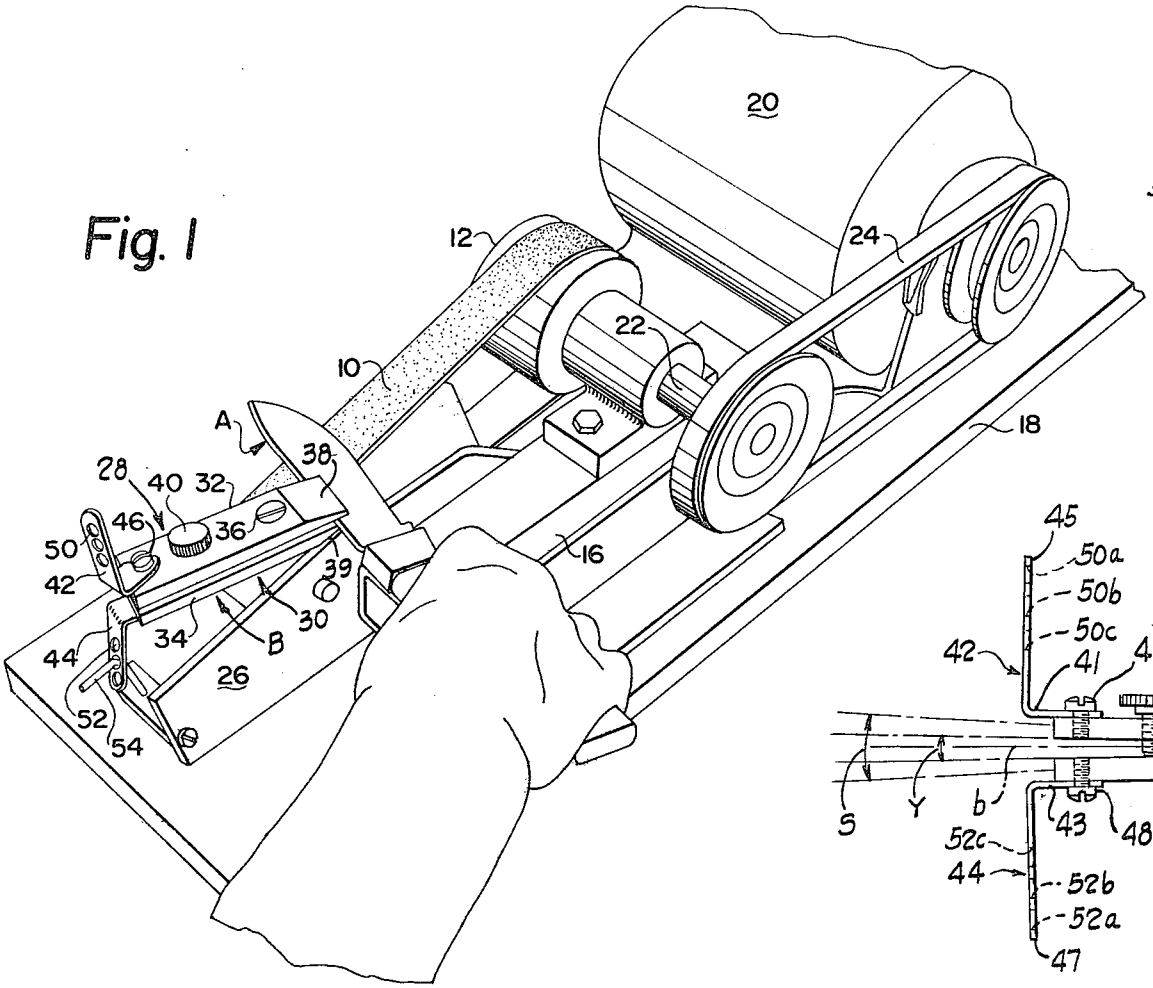
FIG. 1 is a perspective view of one embodiment of the work holder of the present invention illustrating its use in sharpening the blade of a hunting knife on a belt grinder.

With particular reference to FIG. 1 of the drawings the sharpening instrumentality depicted therein is a bench or table top belt type grinder including a continuous abrasive belt 10 reeved about spaced pulley wheels, one of which is shown at 12, rotatably supported in a frame 16 supported on a base 18. The pulley 12 is driven by an electric motor 20 also on the base 18 and connected to the shaft 22 which carries the pulley 12 by a V-belt drive designated generally by the reference character 24. The idler pulley, not shown, is rotatable on a slide 26 forming part of the frame 16 for adjustment towards and from the pulley 12 so that the belt 10 can be tensioned, as desired.

Figure 2:
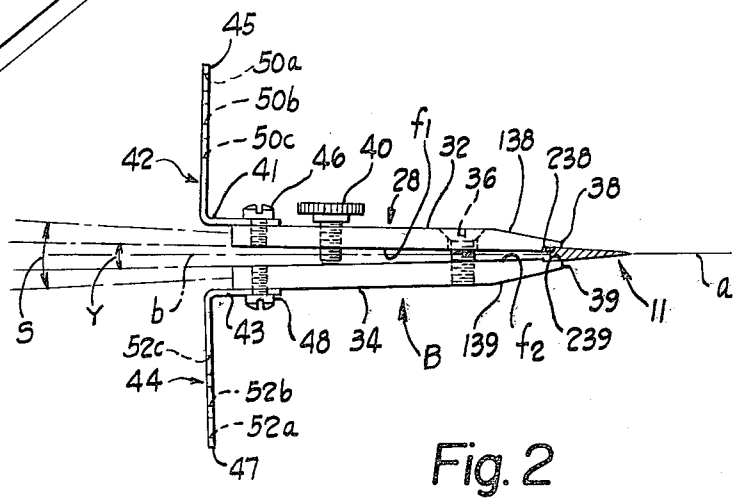
FIG. 2 is a side elevational view of the work holder shown in FIG. 1 with the knife blade shown in section at the near edge of the work holder.

The instrument or work to be sharpened, for example, a hunting knife A, is clamped in a workholder B comprising two clamp members 28, 30 including narrow plate-like members 32, 34, loosely connected to one another by a screw 36 passing through an enlarged aperture in the member 32 and threaded into a tapped aperture in the member 34 adjacent to but spaced from the clamp ends 38, 39 of the members. The facing sides f1 and f2 of the clamp ends 38, 39 of the members 32, 34 nearest to the screw 36 serve as clamp surfaces to clamp a blade between them as the other ends of the members 32, 34 are forced apart by a thumb screw 40 the shank of which is threaded into a tapped through aperture in the member 32 intermediate the screw 36 and the end of the member 32 opposite the clamp end 38, 39 thereof. The end of the shank of the screw 40 opposite the head of the screw abuts the member 34. The sides of the members 32, 34 facing one another are planar and generally parallel with one another. The outer surfaces 138, 139 of the clamp ends 38, 39 are preferably tapered, i.e., bevelled endwise, to provide working clearance for the belt, file, hone or other sharpening tool. The facing sides f1, f2 of the clamp ends 38, 39 of the members 32, 34 are preferably provided with small planar surfaces 238, 239 slightly tapered inwardly toward the clamp ends of the clamp members to better secure a knife blade that is fully tapered to its back edge between them. In the embodiment of the invention shown in FIGS. 1 and 2, the hunting knife A is shown clamped in the work holder B with the cutting edge of the blade located outwardly of the clamp and the center plane a of the blade lying midway between the members 32, 34, i.e. in the center plane b of the dihedral angle y formed by the facing planar sides f1 and f2 of the members 32, 34 and the dihedral angles s formed by the surfaces 238, 239.

The clamp members 28, 30 of the workholder B also include two flanged or angle-like members 42, 44 each pivotally connected to the non-facing side of the members 32, 34, respectively, at the end thereof remote from the clamp end, by having shorter angle parts 41, 43 connected to the members 32, 34, respectively, by screws 46, 48 threaded into tapped apertures in the members 32, 34. The other flanges or parts 45, 47 of the members 42, 44 extend generally at right angles to the members 32, 34 and more particularly at right angles to the clamp surfaces f1, f2 of the members 32, 34 to which they are attached. Each of the parts 45, 47 of the members 42, 44 are provided with a series of apertures 50, 52, respectively, in the depicted workholder three, designated **50*a*, 50*b*, 50*c* and 52*a*, 52*b*, 52*c*, spaced different distances from the members 32, 34, but the respective apertures 50*a*, 52*a*; 50*b*, 52*b*; 50*c*, 52*c* of each series are like distances from the planar clamp surfaces of the member 32, 34 with which the series is associated. As a result, the respective surfaces in the flanges 45, 47 are in equal distance from the center plane a of a blade of a knife or other work piece in the work holder, which lies in the center plane b of the clamp. The distances of the respective apertures of each series of apertures 50, 52 from the planar clamp surface of the member 32, 34 of which they are a part are precise and fixed and are alike in both series. No provisisons are made for adjusting these distances. Each series of apertures includes apertures, for example 50*a*, 52*a* which are like distances from the planar clamp surfaces of the member 32, 34** of which they are a part and therefore the work holder can be employed to unerringly sharpen a blade to like predetermined bevels on each side of its cutting edge.

A rod or pin-like member 54 connected to the slide member 26 of the frame 16 of the machine is adapted to be loosely received in one or another of the series of apertures 50, 52 to locate a workpiece for universal movement, such as, the knife A clamped in the workholder B, in a selected and/or predetermined optimum angle relative to the belt 10 for sharpening. The rod or pin-like member 54 is adjustable vertically in its mounting block and held in place by a set screw (not shown). It is located so a generally horizontal portion that cooperates with the members 42, 44 is slightly below the plane of the belt 10. Preferably the location establishes a slightly shallower angle to the blade edge by the belt than will be established using the same aperture of the series 50, 52 with a hand held tool, such as a hone (in the manner illustrated generally in FIG. 3). Thus the subsequent honing will produce a second steeper bevel on each side of the blade at the cutting edge. This allows the honing to achieve a sharp edge with less time and effort than involved in following the same angle formed by the belt and honing the entire ground surface. It also permits subsequent sharpening by hand many times before regrinding on the belt is required. The clamp members 28, 30 are duplicates of one another except for the threaded apertures in the members 32, 34 which receive the screws 36, 40 thus making it convenient to sharpen both sides of the cutting edge of a workpiece to like angles or bevels without removing it from the workholder by merely inverting the workholder and workpiece as a unit.

Subsequent to grinding or sharpening the cutting edge of the workpiece on the belt 10 the workpiece together with the workholder can be removed from the machine and the cutting edge further or finished sharpened by hand, for example, by use of a tool, such as, a file and/or honing stone. During the hand finishing one or another of the apertures of the series 50, 52 serves as a guide for the hand tool, locating the tool in the optimum position for the desired sharpening operation. If desired, the blade can be entirely hand sharpened using the holder and tools.

Figure 3:
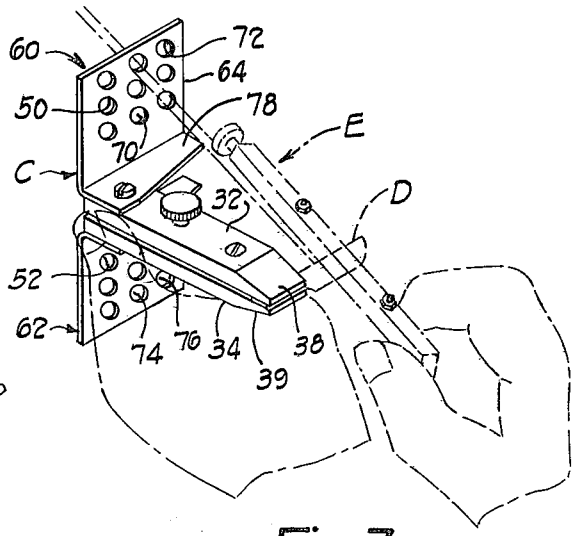
FIG. 3 is a perspective view of a work holder of modified construction illustrating its use in sharpening a small blade of a wood carving knife while held in one hand and a sharpening instrument held in the other hand is moved relative to the cutting edge of the knife.

The workholder shown in FIG. 3 and designated generally by the reference character C is, with the exception of the flanged or angle-like members 60, 62 connected to the clamp members proper, like the work holder B and the duplicate parts are designated by the same reference characters. The flanged or angle-like members 60, 62 are like the members 42, 45 except that the flanges or parts 64, 66 thereof which extend at right angles to the planar clamp surfaces of the respective members 32, 34 to which they are attached are of increased width so that they extend laterally beyond at least one elongated edge side of the clamp members 32, 34. This makes it possible to have further series of apertures 70, 72 and 74, 76 in the parts 64, 66 similar to the series of apertures 50, 52 for guiding a sharpening instrument offset to the side of the clamp members 32, 34 such that the clamp members will not limit the angle at which the sharpening instrument can be located relative to the work being sharpened. In the work holder C illustrated in FIG. 2 of the drawing the parts 78, 80 of the members 60, 62, which parts correspond to the parts 41, 43 of the members 42, 44 of the work holder B are also extended as added support for the portions of the members 64, 66 extending beyond the sides of the members 32, 34. In the work holder C portions of the parts 64, 66 of the members 60, 62 extend only to the right of the members 32, 34 as viewed in the drawing, but the members 60, 62 could be made to extend to the other side of the members 32, 34, if desired.

The work holder C is shown in the drawing as it can be used to sharpen the cutting edge of a small narrow blade D of a wood carving knife using one of the apertures of the series of apertures 72 with the working face of a honing stone E, shown in phantom lines, facing downward and engaging the upper bevelled edge of the blade. The work holder is held in the left hand of the operator while the sharpening member is held in the right hand. The hands of the operator are shown in phantom lines. The laterally offset position of the blade D and aperture series 72 allows a shallow angle of movement of the hone to provide a thin cutting edge to the blade, desired for certain applications, such as wood carving. It will be apparent from the drawing that portions of a narrow blade directly adjacent the clamp members 32, 34 cannot be sharpened to a small angle using the series of apertures 50, 52 because the hone would strike the front of the clamp, the thickness of which would interfere with the path of the hone.

The simple design of the two clamp members 32, 34 of the work holder of this invention and the fact that they are duplicates of one another reduces the cost of manufacture of the work holder and the construction assures that the center plane of the blade of the object to be sharpened lies in the center plane of the clamp, that is, the center plane between parallel clamping surfaces or the center plane of the dihedral angle formed by the planar clamping surfaces of the clamp when they are not parallel. This makes it possible to readily sharpen a blade so that it will have equal or like bevels on both sides of its cutting edge. This is especially important on arrows which travel through air at very high speeds.

It will be understood that while series of apertures, such as 50, 52 are in the form of circular holes in the preferred embodiments, other shapes and constructions, such as slots, could be used to establish a constant angular relationship between the tool and the article being sharpened.

From the foregoing description of the depicted apparatus it will be apparent that the objects of the invention heretofore mentioned and others have been accomplished and that a simple, rugged, inexpensive sharpener has been provided which makes it possible to unerringly sharpen both sides of the cutting edge of a workpiece to the same predetermined desired bevel.

I claim:

1. A portable work holder for positioning and maintaining an article to be sharpened, such as, a knife, in predetermined relative position to a sharpening member or tool for the purpose of sharpening the same with a predetermined like bevel on both sides of its cutting edge comprising two duplicate clamp members including duplicate relatively long narrow members having opposed planar clamping surfaces adjacent to one of their ends and the opposite sides of said ends beveled endwise, means adjacent to but spaced from said one ends of said members pivotally connecting said members together, means between said first mentioned means and other ends of said members opposite to said one ends thereof for moving said one ends of said members toward one another, each of said members having a part provided wih at least one aperture extending generally normal to said planar surface of the member of which it is a part and in the direction away from the other member, said at least one aperture in said parts of said members each being located at a like fixed distance from said planar surface of said member of which each is a part whereby the center plane of a knife blade clamped between said planar surfaces will be exactly midway between corresponding apertures of the clamp members.

2. A portable work holder as claimed in claim 1 wherein said apertured parts of the relatively long narrow members extend laterally beyond at least one longitudinal side of the members and each extending part has said at least one aperture therein which is laterally beyond said longitudinal side and a like distance from the plane of the planar surface of the member of which it is a part as is the corresponding aperture of the other member from the plane of the planar surface of the other member of which it is a part.

* * * * *